US009088087B2

(12) United States Patent
Wardenburg

(10) Patent No.: US 9,088,087 B2
(45) Date of Patent: Jul. 21, 2015

(54) DUAL INTERCHANGEABLE ELECTRICAL RECEPTACLE

(71) Applicant: Peter Wardenburg, Petaluma, CA (US)

(72) Inventor: Peter Wardenburg, Petaluma, CA (US)

(73) Assignee: HYDROFARM, INC., Petaluma, CA (US)

( * ) Notice: Subject to any disclaimer, the term of this patent is extended or adjusted under 35 U.S.C. 154(b) by 237 days.

(21) Appl. No.: 13/712,909

(22) Filed: Dec. 12, 2012

(65) Prior Publication Data

US 2014/0162478 A1 Jun. 12, 2014

(51) Int. Cl.

| | |
|---|---|
| ***H01R 13/447*** | (2006.01) |
| ***H01R 13/44*** | (2006.01) |
| ***H01R 27/00*** | (2006.01) |
| *H01R 24/22* | (2011.01) |

(52) U.S. Cl.

CPC ..... *H01R 13/447* (2013.01); *H01R 13/44* (2013.01); *H01R 27/00* (2013.01); *H01R 24/22* (2013.01)

(58) Field of Classification Search

USPC ..... 439/133–139, 145, 149, 535, 536, 367, 439/373; 220/242, 3.2, 3.8, 23.86, 525; 174/67, 17 CT

See application file for complete search history.

(56) References Cited

U.S. PATENT DOCUMENTS

| | | | | |
|---|---|---|---|---|
| 3,876,273 | A | 4/1975 | Schwartz | |
| 4,159,858 | A | 7/1979 | Toraya | |
| 4,250,349 | A | 2/1981 | Bennett | |
| 4,733,017 | A * | 3/1988 | Wolfe-Taylor et al. | 174/67 |
| 4,760,215 | A | 7/1988 | Cook | |
| 5,078,614 | A * | 1/1992 | Shotey | 439/136 |
| 5,096,430 | A | 3/1992 | D'Amico | |
| 5,238,416 | A | 8/1993 | Dickie | |
| 5,934,919 | A * | 8/1999 | Cross et al. | 439/136 |
| 6,468,107 | B1 * | 10/2002 | Nice et al. | 439/536 |
| 8,777,655 | B2 * | 7/2014 | Blanton | 439/372 |
| 2010/0117453 | A1 * | 5/2010 | Langgood et al. | 307/75 |

* cited by examiner

*Primary Examiner* — Abdullah Riyami

*Assistant Examiner* — Harshad Patel

(74) *Attorney, Agent, or Firm* — Craig M. Stainbrook; Stainbrook & Stainbrook, LLP

(57) ABSTRACT

A dual electrical receptacle having a backshell having a proximal end and a distal end; a wiring assembly housed within said backshell and configured for connection to an electrical cord from said proximal end of said backshell; a first female receptacle electrically connected to said wiring assembly and disposed inside said backshell, said first female receptacle having a first receptacle configuration; a second female receptacle electrically connected to said wiring assembly and disposed inside said backshell, said second female receptacle having a second receptacle configuration; a frame disposed on said distal end of said backshell and around said first and second female receptacles; a cover slidingly disposed on said frame which selectively covers said first female receptacle when said second female receptacle is uncovered for use, and which can be slidingly translated to cover said second female receptacle when said first female receptacle is to be used.

4 Claims, 6 Drawing Sheets

DUAL INTERCHANGEABLE ELECTRICAL RECEPTACLE

CROSS REFERENCES TO RELATED APPLICATIONS

Not applicable. The present application is an original and first-filed United States Utility Patent Application.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

BACKGROUND OF THE INVENTION

1. Field of the Invention

The present invention relates generally to electrical cords, such as power cords, and more specifically to electrical cord plugs and receptacles, and still more particularly to a dual and interchangeable electrical cord receptacle.

2. Background Discussion

A standard electrical power or extension cord in its simplest aspect generally includes a male plug end and a female receptacle end. Over the years the receptacle end has been developed and modified in countless ways to address the myriad uses to which such cords are put. Such improvements have included the provision of multiple outlets or receptacles and the addition of safety covers for unused outlets, the latter largely extending concepts earlier embodied in outlet safety covers. Exemplary patents include:

U.S. Pat. No. 4,159,858, to Toraya, U.S. Pat. No. 4,250,349, to Bennett, U.S. Pat. No. 4,760,215 to Cook et al, and U.S. Pat. No. 5,096,430, to D'Amico, all of which teach hinged safety covers for outlets, which allow for selective covering and uncovering of sockets, such that multiple sockets can be covered and any unused but energized sockets can remain covered.

U.S. Pat. No. 3,876,273 to Schwartz and U.S. Pat. No. 5,238,416 to Dickie each teach a multiple socket service block mounted on the end of an electrical cord. The blocks include sockets disposed on opposing sides of the service block, each having a dielectric flap with tabs that insert into the receptacle (socket) slots, such that sockets can be selectively covered or uncovered, and as with the outlets described above, one or more sockets can be covered while another or others are in use.

The foregoing patents reflect the current state of the art of which the present inventors are aware. Reference to, and discussion of, these patents is intended to aid in discharging Applicants' acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein. Specifically, none teach an electrical cord receptacle connector having multiple receptacle configurations with a sliding cover and bale wire strain relief and cord lock, as taught by the present invention.

The limitation in the prior art devices is immediately evident when the devices are used. Notably, the hinged dielectric safety covers stick out prominently from the outlet or connector creating and ungainly flap. In the case of both connectors disposed on the end of an electric cord and wall outlets, the flaps can catch and constitute a kind structural clutter. There remains a need for a structurally simple, spare, and clean selective outlet safety cover for electrical cord connectors.

BRIEF SUMMARY OF THE INVENTION

The present invention is an electrical cord end connector including dual receptacles of different configurations with a sliding cover that enables a user to expose one receptacle for use while simultaneously covering the other receptacle for safety and receptacle protection. The connector includes a selectively removable bale wire strain relief and cord lock that can be moved for use on a power cord connected to either of the receptacles.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

Also, it is to be understood that the terminology and phraseology employed herein are for descriptive purposes only, and not limitation. As will be appreciated, an electrical cord receptacle can be employed in an infinite number of orientations relative to a reference plane. Accordingly, where descriptive terms such as top, bottom, right, left, front, back, and the like are employed, it is for orientation in viewing the drawings only. Further, if specific dimensional and material specifications have been included or omitted from the specification or the claims, or both, it is to be understood that the same are not to be incorporated into the appended claims.

As such, those skilled in the art will appreciate that the conception, upon which this disclosure is based, may readily be used as a basis for designing other structures, methods, and systems for carrying out the several purposes of the present invention. It is important, therefore, that the claims are regarded as including such equivalent constructions as far as they do not depart from the spirit and scope of the present invention. Rather, the fundamental aspects of the invention, along with the various features and structures that characterize the invention, are pointed out with particularity in the claims annexed to and forming a part of this disclosure. For a better understanding of the present invention, its advantages and the specific objects attained by its uses, reference should be made to the accompanying drawings and descriptive matter in which there are illustrated the preferred embodiment.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1A:
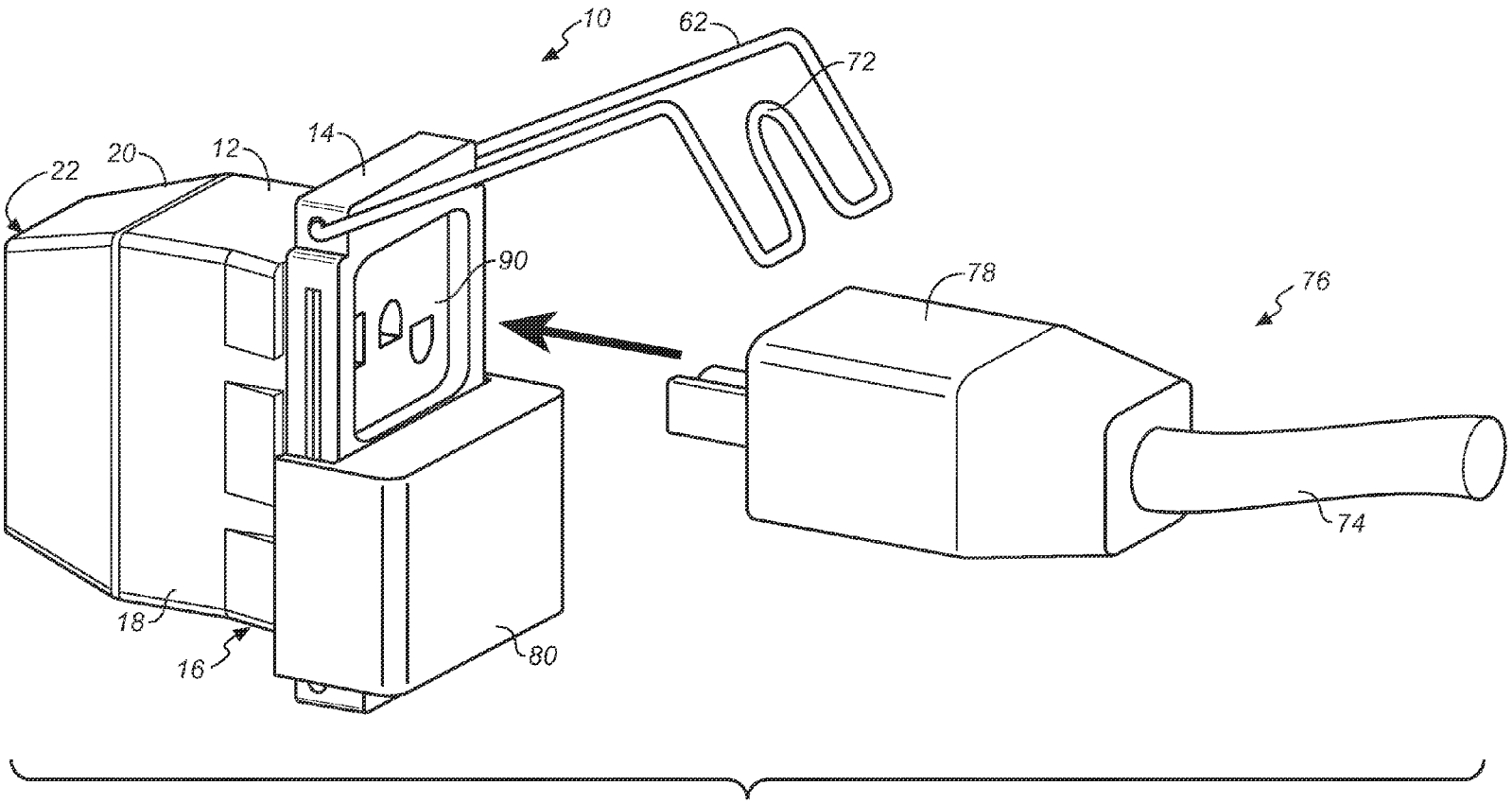
FIG. 1A is an upper front perspective view of the dual and interchangeable receptacle of the present invention, showing the apparatus prepared for connection at its upper receptacle to an electrical power cord.
Figure 1B:
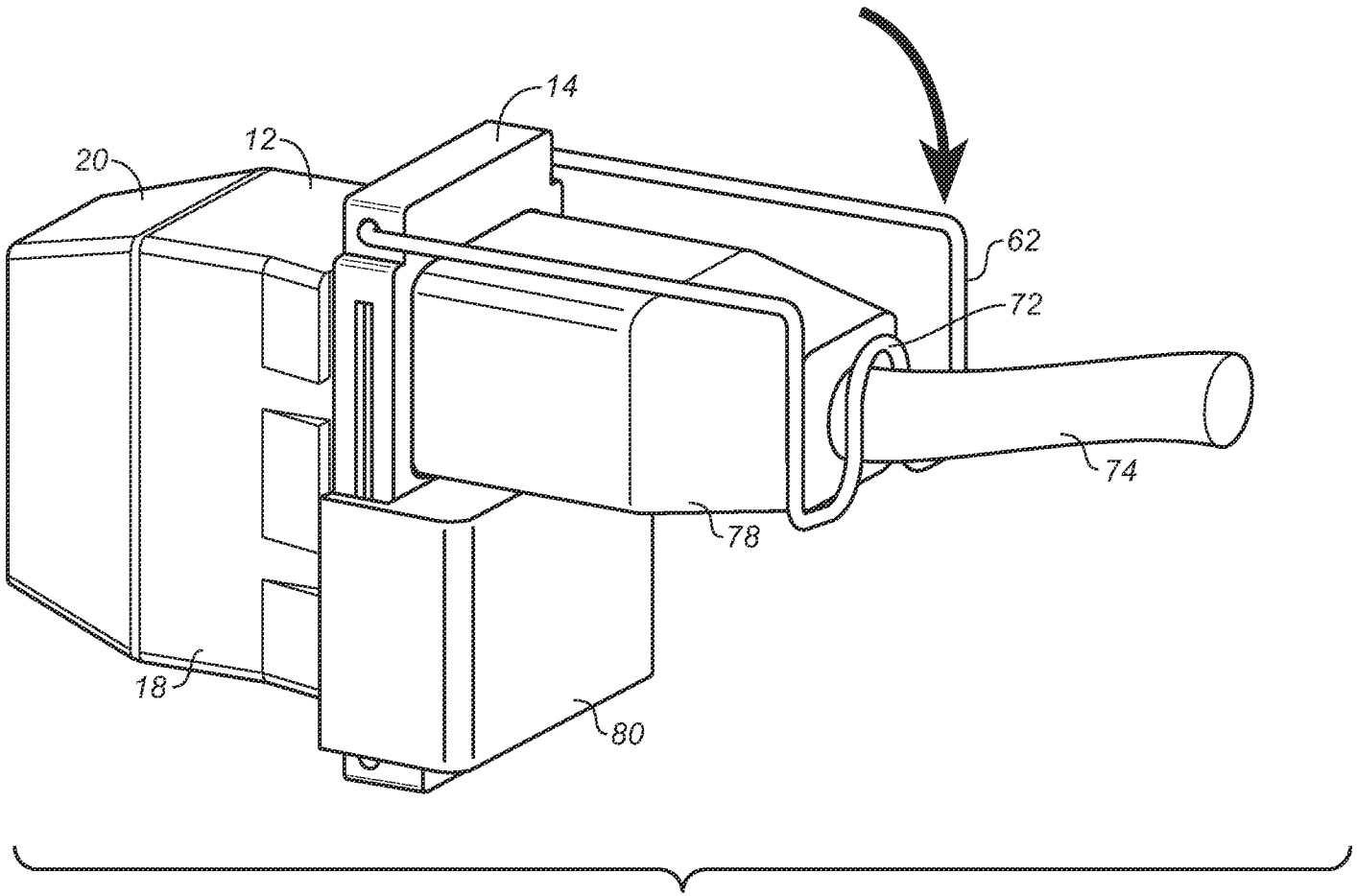
FIG. 1B is the same view showing the inventive dual receptacle connected to the power cord, with the strain relief and cord lock bale wire in use.

Referring to FIGS. 1 through 5, wherein like reference numerals refer to like components in the various views, there is illustrated therein a new and improved electrical cord end receptacle that includes two or more female receptacle configurations, a sliding cover, and bale wire strain relief and cord lock. The apparatus is generally denominated 10 herein.

The figures collectively show a preferred embodiment of the inventive female receptacle, which in its most essential aspect includes a molded plastic backshell 12 for housing and protecting the wire connections of the cord or cable and the receptacle elements, and a frame or flange 14 disposed on the distal end 16 of the backshell. The frame may be manufactured integral with the backshell, or it may be affixed in assembly.

The backshell includes a generally a distal portion 18 shaped as a rectangular cuboid box and a beveled portion 20, the latter terminating in a generally planar proximal end 22. In the preferred embodiment shown, the electrical cord or cable 24 enters the backshell through the back side.

The flange 14 is sized to have a perimeter slightly larger than the perimeter of the distal edge 26 of the backshell distal portion 20, though this size relationship is one of design choice and is not essential to the structure or operation of the receptacle. Indeed, the flange could have dimensions essentially matching those of the distal edge of the backshell. Because the distal portion of the backshell is a rectangular cuboid box, the flange is also preferably generally rectangular is shape. The right and left sides 28, 30 (the longer sides) of the backshell front portion immediately behind the flange each preferably include a plurality of integral fins 32, 34 providing increased structural integrity, facilitating ease in connecting the receptacle to a male cord element without placing stress on the flange itself when left uncovered by an exterior housing, and providing structure for a friction fit of any exterior shell or housing installed over the backshell.

The right and left sides of the flange 36, 38 (also the longer sides) each include a vertically oriented slot 40, 42 (the latter not shown) generally centered in the flange. The upper and lower portions 44, 46 of the flange include shoulders 48, 50 that taper to a front profile slightly narrower than the medial portion 52 of the flange, and each upper and lower portion includes bale holes 54, 56 in which the ends 58, 60 of a bale wire 62 are pivotally disposed. The bale wire ends are each oriented generally normal to an arm 64, 66, which bend into legs 68, 70 converging and joining in an arcuate crotch portion 72, which is used to capture the cord portion 74 of a power cord 76 having a male end 78 when the male end is inserted into one of the female receptacles.

A U-shaped sliding cover 80 includes a front cover portion 82 and right and left arms 84, 86. Each sliding cover arm is provided with a tab (not shown, but well known) on its inner side that fits slidingly into the vertical slots 40, 42 on the sides of the flange 14. The arms are slightly resilient so as to urge the each tab into its respective slot. As will be appreciated, the tab and slot structures provided on the flange and sliding cover arms could be disposed on the opposite element, such that the flange includes tabs and the cover arms includes complementary slots for slidable placement of the cover on the flange.

The front of the frame includes a first receptacle 88, preferably recessed, and presenting a first female receptacle configuration 90, and a second female receptacle 92, which may also be set in a recess or presented on a projection 94. If presented on a projection, the projection configuration is sized and shaped to insert into a complementary recess of a male plug element defined by a perimeter skirt at the outer end and edge of the male plug. Preferably the projection also includes a base groove 95 for capturing a resilient ring disposed on the interior of a skirt on the end of a male plug, as described above. As will be appreciated, when the second female receptacle is disposed on a projection, the sliding cover 80 is provided with a wall 96 on one side and an opening 98 on the other, so as to segregate the receptacles while enabling the sliding cover to slide over the projection when the first receptacle is in use. A shelf 97 dividing the first and second female receptacle provides enhanced water channeling over and away from the second female receptacle.

Figure 1C:
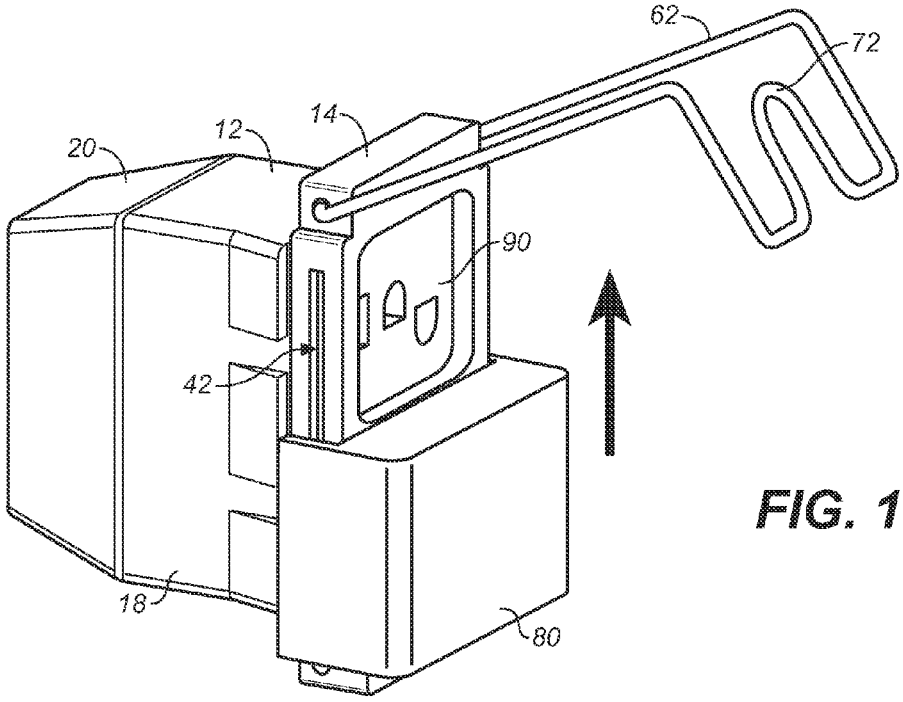
FIG. 1C is the same view showing the electrical power cord removed from the upper receptacle and the sliding safety cover prepared for translation up.
Figure 1D:
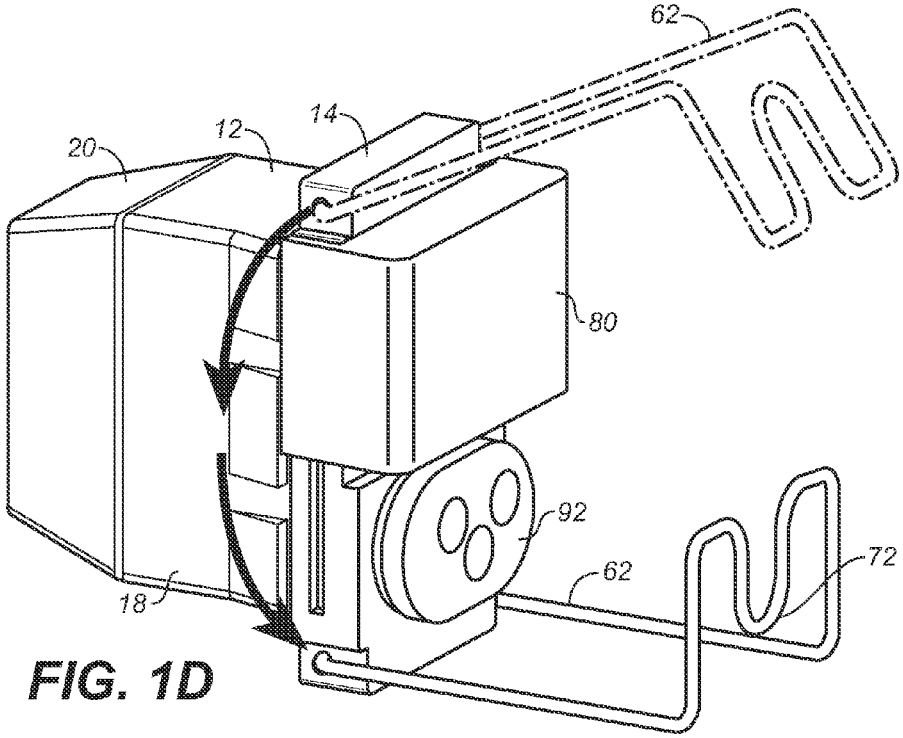
FIG. 1D is the same view showing the sliding cover moved over the upper receptacle, the lower receptacle exposed, and the bale wire moved to a lower position.
Figure 1E:
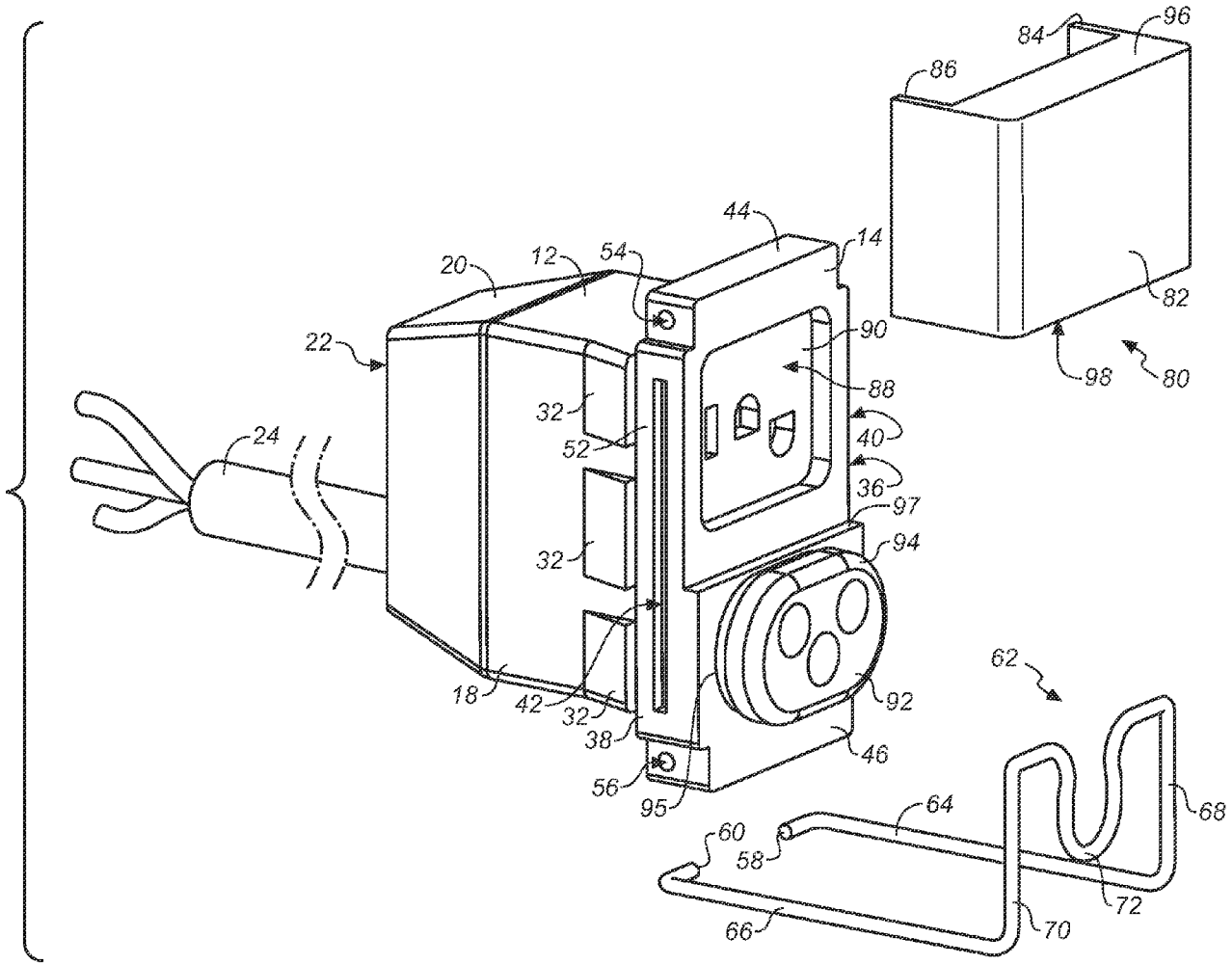
FIG. 1E is an upper exploded perspective view showing the principal elements of the apparatus.
Figure 1F:
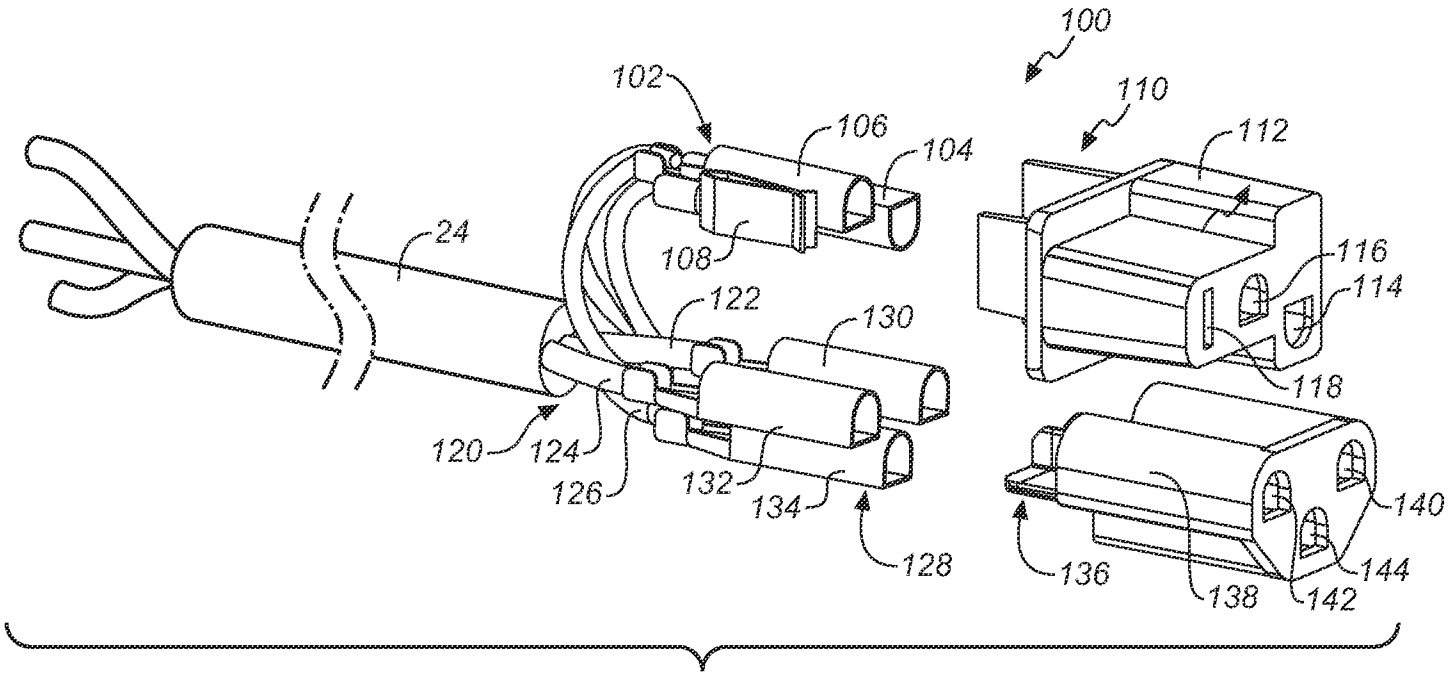
FIG. 1F is an upper perspective view showing the connector body removed to disclose the internal operational elements.
Figure 2:
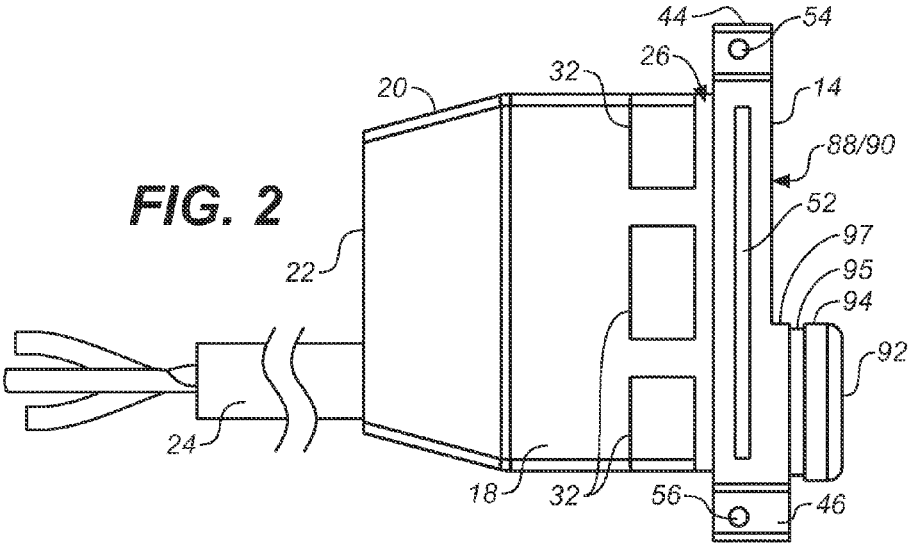
FIG. 2 is a side view in elevation showing the connector body with the sliding cover and bale wire removed.
Figure 3:
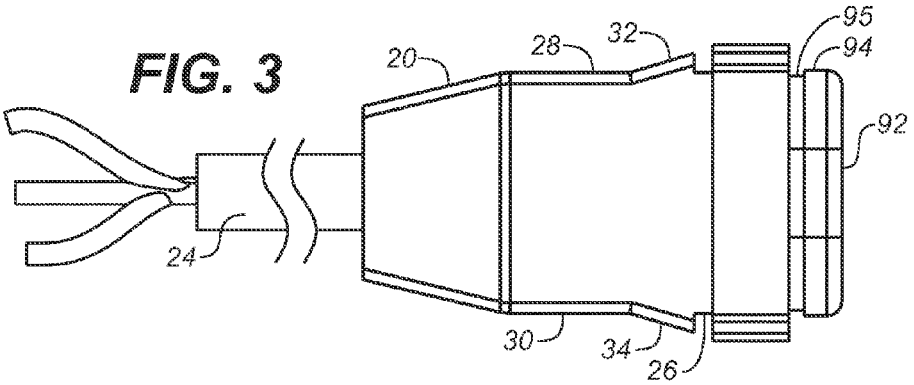
FIG. 3 is a bottom plan view thereof.
Figure 4:
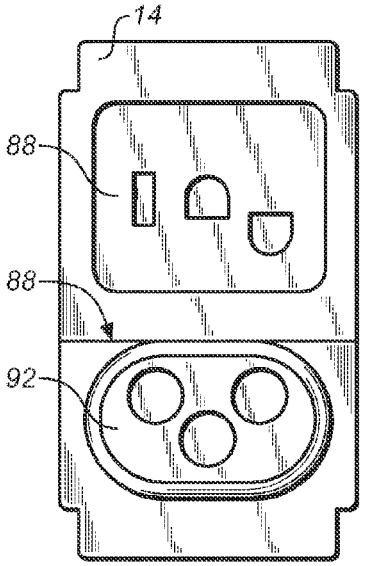
FIG. 4 is a front view in elevation thereof.
Figure 5:
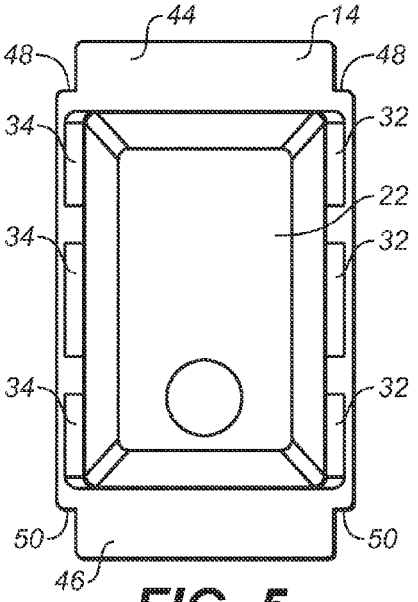
FIG. 5 is a rear view in elevation thereof.

Referring now specifically to FIG. 1F, a wiring assembly 100 is housed within the backshell after penetrating the distal end of the backshell. The wiring assembly includes a first set of conductive connectors 102, or wire ends, including a hot 104, neutral 106, and ground connector 108, each coupled to a complementary conductor in a first set 110 of conductor leads disposed in a first receptacle unit 112, which may, as an example, include a hot female pin hole 114, a neutral female pin hole 116, and a ground spade slot 118. Wires from the conductor set are connected to the wire ends 120 extending from cord 24, typically a twisted triplexed set of wires. The wire ends include a hot wire 122, a neutral wire 124, and a ground wire 126, to which are connected a second set 128 of conductive connectors, including a hot connector 130, a neutral connector 132, and a ground connector 134, and which are, in turn, coupled to a complementary conductor in a second set 136 of conductor leads disposed in a second receptacle unit 138, which may include a hot female pin hole 140, a neutral female pin hole 142, and a ground pin hole 144.

As can be seen by reference to FIGS. 1A through 1D, when a user wishes to use the first receptacle, the sliding cover is moved over the second receptacle to expose the first receptacle, and the wire bale ends are disposed in the first set of bale holes 54. A male plug 76 is connected to the first receptacle and the bale wire is pivoted so as to capture the cord 74 with the crotch portion 72 of the bale wire 62. This provides both locking and strain relief functions.

Referring next to FIGS. 1C and 1D, when it is desired to switch to use of the second receptacle 92, the bale wire is pivoted off the male plug, the wire is removed and the ends inserted into the second set of bale holes 56, and the sliding cover is translated so as to cover the first receptacle, thereby exposing the second receptacle. Connection of a second kind of male plug can then be accomplished with the bale wire employed as above for cord locking and strain relief.

From the foregoing, it is clear that in its most essential aspect, the present invention is a dual interchangeable electrical receptacle A dual electrical receptacle, comprising a backshell having a proximal end and a distal end; a wiring assembly housed within said backshell and configured for connection to an electrical cord from said proximal end of said backshell; a first female receptacle electrically connected to said wiring assembly and disposed inside said backshell, said first female receptacle having a first receptacle configuration; a second female receptacle electrically connected to said wiring assembly and disposed inside said backshell, said second female receptacle having a second receptacle configuration; a frame disposed on said distal end of said backshell and around said first and second female receptacles; and a cover slidingly disposed on said frame which selectively covers said first female receptacle when said second female receptacle is uncovered for use, and which can be slidingly translated to cover said second female receptacle when said first female receptacle is to be used.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

SEQUENCE LISTING

Not applicable.

What is claimed as invention is:

1. A dual electrical receptacle, comprising:

a backshell having a proximal end and a distal end;

a wiring assembly housed within said backshell and configured for connection to an electrical cord through said proximal end of said backshell;

a first female receptacle electrically connected to said wiring assembly and disposed inside said backshell, said first female receptacle having a first receptacle configuration;

a second female receptacle electrically connected to said wiring assembly and disposed inside said backshell, said second female receptacle having a second receptacle configuration;

a frame disposed on a distal edge of said distal end of said backshell, said frame surrounding said first and second female receptacles; and a cover slidingly disposed on said frame, said cover structured for slidable translation on said frame to selectively cover one of said first and second female receptacles while leaving the other receptacle exposed and available for use; and wherein said first female receptacle is disposed in a recess in said frame, and said second female receptacle is disposed on a projection extending from said distal end of said backshell.

2. The dual electrical receptacle of claim 1, wherein the cover is a slidable cover including a wall on a first side and an opening on a second side, said opening accommodating said second female receptacle, such that when said slidable cover is covering said second female receptacle, said wall partitions said first and second female receptacles.

3. The dual electrical receptacle of claim 1, wherein said frame is generally rectangular in shape and includes slots disposed along longer sides, and the cover is U-shaped and includes a front portion and arms, each of said arms having an interior tab for slidable insertion into said slots.

4. The dual electrical receptacle of claim 1, wherein said frame is generally rectangular in shape and includes tabs disposed along longer sides, and the cover is U-shaped and includes a front portion and arms, each of said arms having an interior slot into which said tabs are slidably inserted.

* * * * *